US011204029B2

(12) United States Patent
Ren

(10) Patent No.: US 11,204,029 B2
(45) Date of Patent: Dec. 21, 2021

(54) LOADLESS START VALVE FOR A COMPRESSOR

(71) Applicant: QUINCY COMPRESSOR LLC, Bay Minette, AL (US)

(72) Inventor: Tingrong Ren, Spanish Fort, AL (US)

(73) Assignee: QUINCY COMPRESSOR LLC, Bay Minette, AL (US)

( * ) Notice: Subject to any disclaimer, the term of this patent is extended or adjusted under 35 U.S.C. 154(b) by 110 days.

(21) Appl. No.: 16/553,836

(22) Filed: Aug. 28, 2019

(65) Prior Publication Data

US 2020/0149527 A1 May 14, 2020

Related U.S. Application Data

(60) Provisional application No. 62/767,106, filed on Nov. 14, 2018.

(51) Int. Cl.

| | |
|---|---|
| ***F04B 49/035*** | (2006.01) |
| ***F04B 39/00*** | (2006.01) |
| ***F04B 49/03*** | (2006.01) |
| ***F04B 53/10*** | (2006.01) |
| ***F04B 39/10*** | (2006.01) |

(52) U.S. Cl.

CPC ..... *F04B 49/035* (2013.01); *F04B 39/0061* (2013.01); *F04B 39/10* (2013.01); *F04B 49/03* (2013.01); *F04B 53/10* (2013.01)

(58) Field of Classification Search

CPC ..... F04B 49/03; F04B 49/035; F04B 49/225; F04B 39/0061; F04B 53/10; F04B 53/06; F16K 24/04; F16K 37/0033; F16K 27/041; F16K 3/24; Y10T 137/7842; Y10T 137/0379; Y10T 137/777; Y10T 137/7785; Y10T 137/7848; Y10T 137/7869; Y10T 137/7886; Y10T 137/7904

See application file for complete search history.

(56) References Cited

U.S. PATENT DOCUMENTS

| | | | | |
|---|---|---|---|---|
| 2,046,228 A * | 6/1936 | Wiedmann | F16K 24/04 | 137/517 |
| 2,511,494 A * | 6/1950 | Abraham | F04D 27/02 | 417/26 |
| 3,260,444 A * | 7/1966 | Williams | F04C 18/16 | 417/228 |
| 4,291,789 A * | 9/1981 | Bogenschutz | F16D 65/74 | 188/196 A |
| 5,228,646 A * | 7/1993 | Raines | A61M 39/22 | 251/322 |

(Continued)

*Primary Examiner* — Dominick L Plakkoottam
(74) *Attorney, Agent, or Firm* — Bacon & Thomas, PLLC

(57) ABSTRACT

A compressor installation having a reduced load at start-up, including a gas compressor having an inlet and an outlet and a start-up valve connected to the outlet of the compressor. The start-up valve includes a valve body having an inlet and an outlet, a valve plunger connected to the inlet of the valve body, a spring connected to the valve body and the valve plunger, and a muffler. The start-up valve is configured to discharge the compressed gas through the muffler to atmosphere to reduce the load on the motor at start-up. After starting the compressor, the spring in the start-up valve is compressed after pressure is increased by the compressor and the discharge through the start-up valve to atmosphere is closed.

17 Claims, 7 Drawing Sheets

(56) References Cited

U.S. PATENT DOCUMENTS

| | | | | | |
|---|---|---|---|---|---|
| 5,697,351 | A * | 12/1997 | Schumacher | F01M 13/023 | 123/574 |
| 6,148,631 | A * | 11/2000 | Watanabe | F25B 41/40 | 62/296 |
| 6,793,480 | B2 * | 9/2004 | Dominka | B29C 45/1735 | 425/563 |
| 7,086,841 | B2 * | 8/2006 | Cornwell | F04B 39/10 | 137/492.5 |
| 7,260,951 | B2 * | 8/2007 | Monk | F04C 28/06 | 62/196.3 |
| 9,732,871 | B2 * | 8/2017 | Fletcher | F02B 37/16 | |
| 2011/0123377 | A1 * | 5/2011 | Bredel | F04B 49/03 | 417/559 |
| 2012/0325331 | A1 * | 12/2012 | Mangiagli | G05D 16/101 | 137/12 |
| 2014/0050575 | A1 * | 2/2014 | Kim | F04D 29/0516 | 415/203 |
| 2017/0307098 | A1 * | 10/2017 | Fletcher | F16K 37/0033 | |
| 2018/0238322 | A1 * | 8/2018 | McMullen | F04B 49/03 | |

* cited by examiner

LOADLESS START VALVE FOR A COMPRESSOR

CROSS REFERENCE OF RELATED APPLICATIONS

This application claims the benefit of provisional application No. 62/767,106, filed Nov. 14, 2018, the disclosure of which is incorporated herein by reference.

FIELD OF THE INVENTION

The present invention relates generally to a gas compressor installation which includes a start-up valve that reduces the amount of required power for starting up the gas compressor.

BACKGROUND OF THE INVENTION

Compressor installations may include a motor, a gas compressor driven by the motor, and a storage tank to store gas that has been compressed by the gas compressor. The motor may be an electric motor, an internal combustion engine, or another type of motor. The gas may be air or another gas. The compressor may be a reciprocating piston compressor, a centrifugal compressor, a scroll compressor, a screw compressor having male and female compressor elements, or another type of compressor. The storage tank may be a canister, reservoir, or other type of tank, that contains the compressed gas until it is used to power a device such as a tool, or used by an end user, or released to atmosphere. In most cases, air is drawn into an inlet air side of the gas compressor from atmosphere, and then mechanically compressed, e.g., via pistons or male and female rotors, into a smaller volume in the compression chamber of the gas compressor. The compressed gas flows through a pipe or the like, to the storage tank. As the compressed air is used from the storage tank by the end user, the compressor may be operated to maintain a set pressure. The load on the motor driving the compressor will depend on a number of factors, such as user demand, backpressure, start-up etc.

For example, in a reciprocating compressor, which is widely used in various industrial and domestic applications, the motor is used to drive a pulley to drive a crankshaft that moves piston(s) in a reciprocating manner, where gas enters the suction side, typically through an inlet manifold, is compressed via the piston(s) being driven in a reciprocating manner, and then discharged at high pressure into a tank.

However, when a reciprocating compressor is started, a maximum amount of power is consumed by the motor to start the reciprocating compressor. Electric motors have an inrush current when first started and the power required to bring a reciprocating compressor from standstill, e.g., stopped, to full speed is the greatest when starting the reciprocating motor from stoppage. This is at least because the reciprocating compressor is compressing air as it is started, which adds to the power required for start-up. In order to decrease the amount of power required for starting up the reciprocating compressor and reduce the load on the motor, the compressor can be unloaded so that the compressor is not pumping up the residual air pressure in the system, e.g., having to compress the compressed air which is at a higher pressure than atmospheric.

While there have been several methods used to unload a reciprocating compressor, such methods typically require specific compressor designs or use solenoid valves with timer relays to accomplish this unloading, which adds large and significant costs to the compressor and/or design of the system.

In view of such drawbacks of the known methods, there is a need to provide a simpler, smaller, and more cost-effective structure for unloading a compressor for start-up.

SUMMARY OF THE INVENTION

The present invention is provided to solve the deficiencies of the prior art by providing improvements over the prior art. It is an object of the present invention to provide a start-up valve that is an improvement over the prior art in several ways, at least because it costs less than a compressor design that has a specific unloading configuration, is much smaller, and can be attached directly to the compressor discharge of any compressor, e.g., discharge of a reciprocating compressor.

The present invention has no requirement for a specific compressor design for a special unloading method, but rather uses a start-up valve that can be used to divert the discharge of the compressor to atmosphere, thereby reducing the load on the motor at start-up. After starting-up the compressor, a short delay can be used after which the discharge to atmosphere is closed and the compressor resumes normal compression.

In one embodiment of the invention, the start-up valve comprises a valve body having an inlet, an internal passageway, and an outlet; a valve plunger connected at the inlet of the valve body; and a spring provided within the internal passageway and connected to the valve plunger. The start-up valve is configured so that when the spring is in a relaxed state (e.g., having a longer length than in a compressed state), the valve plunger is positioned away from the internal passageway to allow gas to flow around or through the valve plunger and through the valve body. As the compressor starts-up and gas flow increases, the spring is compressed until the valve plunger abuts the internal passageway which seals the inlet of the valve body and the gas no longer flows through the valve body.

When such a compressor is shut-down, the spring returns to the relaxed state and forces the valve plunger away from the internal passageway to allow gas to flow around or through the valve plunger and valve body to unload the compressor.

In another embodiment of the invention, the invention includes a compressor and a start-up valve that comprises a valve body having an inlet, an internal passageway, and an outlet; a valve plunger connected at the inlet of the valve body; and a spring provided within the internal passageway and connected to the valve plunger. The start-up valve is configured so that when the spring is in a relaxed state during a start-up of the compressor, the valve plunger is positioned away from the internal passageway to allow gas to flow around or through the valve plunger and the valve body. After the compressor starts-up and gas flow/pressure increases, the spring is compressed until the valve plunger abuts the internal passageway which shuts-off and seals the inlet of the valve body so that the gas no longer flows through the valve body.

BRIEF DESCRIPTION OF THE DRAWINGS

The features and objects of the present invention are more clearly understood from the detailed description taken in conjunction with the accompanying drawings, in which.

Figure 1A:
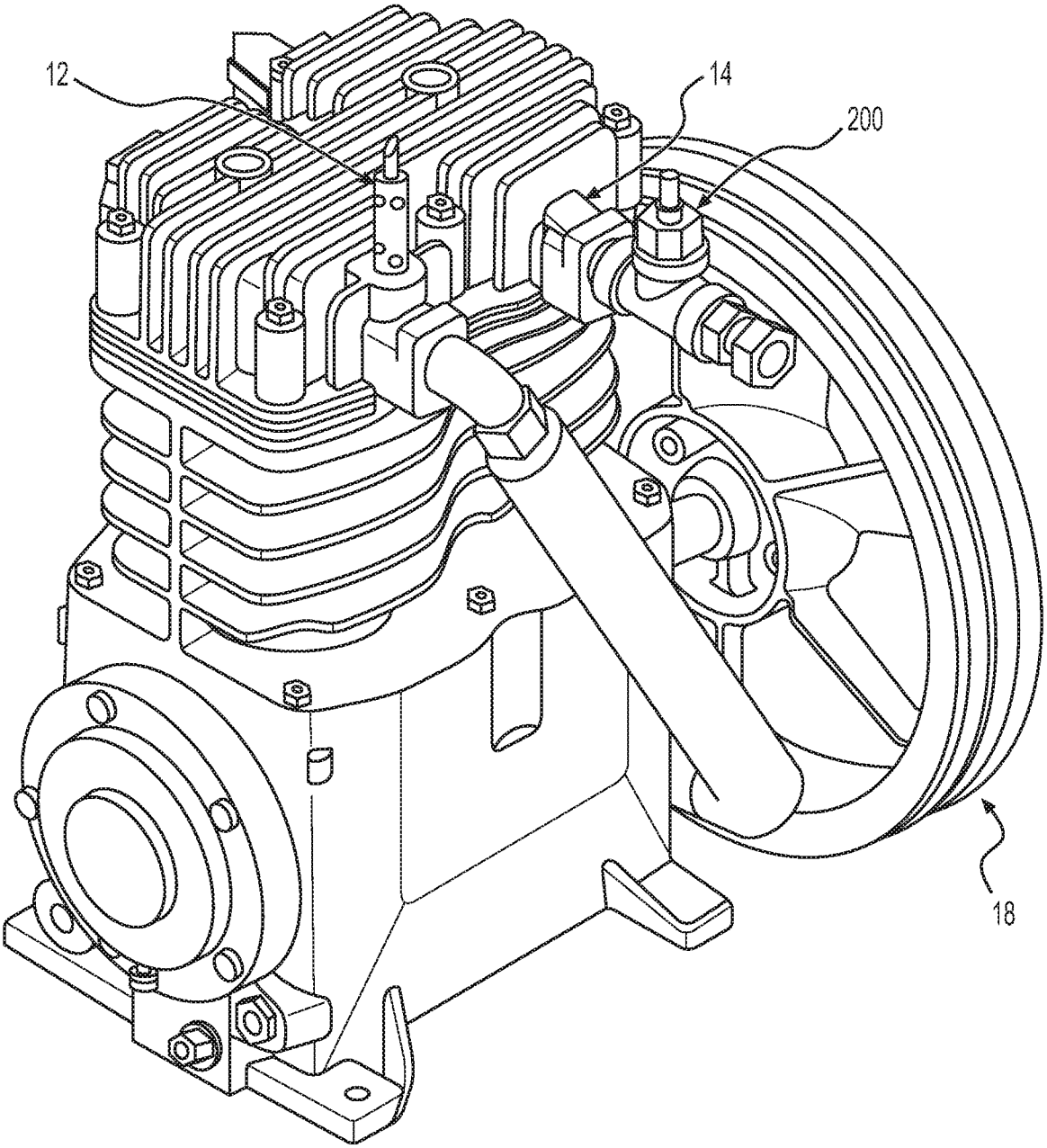
FIG. 1A illustrates a compressor with the start-up valve according to the present invention.

In the various figures, similar elements are provided with similar reference numbers. It should be noted that the drawing figures are not necessarily drawn to scale, or proportion, but instead are drawn to provide a better understanding of the components thereof, and are not intended to be limiting in scope, but rather provide exemplary illustrations.

DETAILED DESCRIPTION OF THE INVENTION

The present invention will be described with respect to particular embodiments and with reference to certain drawings but the invention is not limited thereto and can be combined interchangeably with certain features in the different embodiments.

Figure 1B:
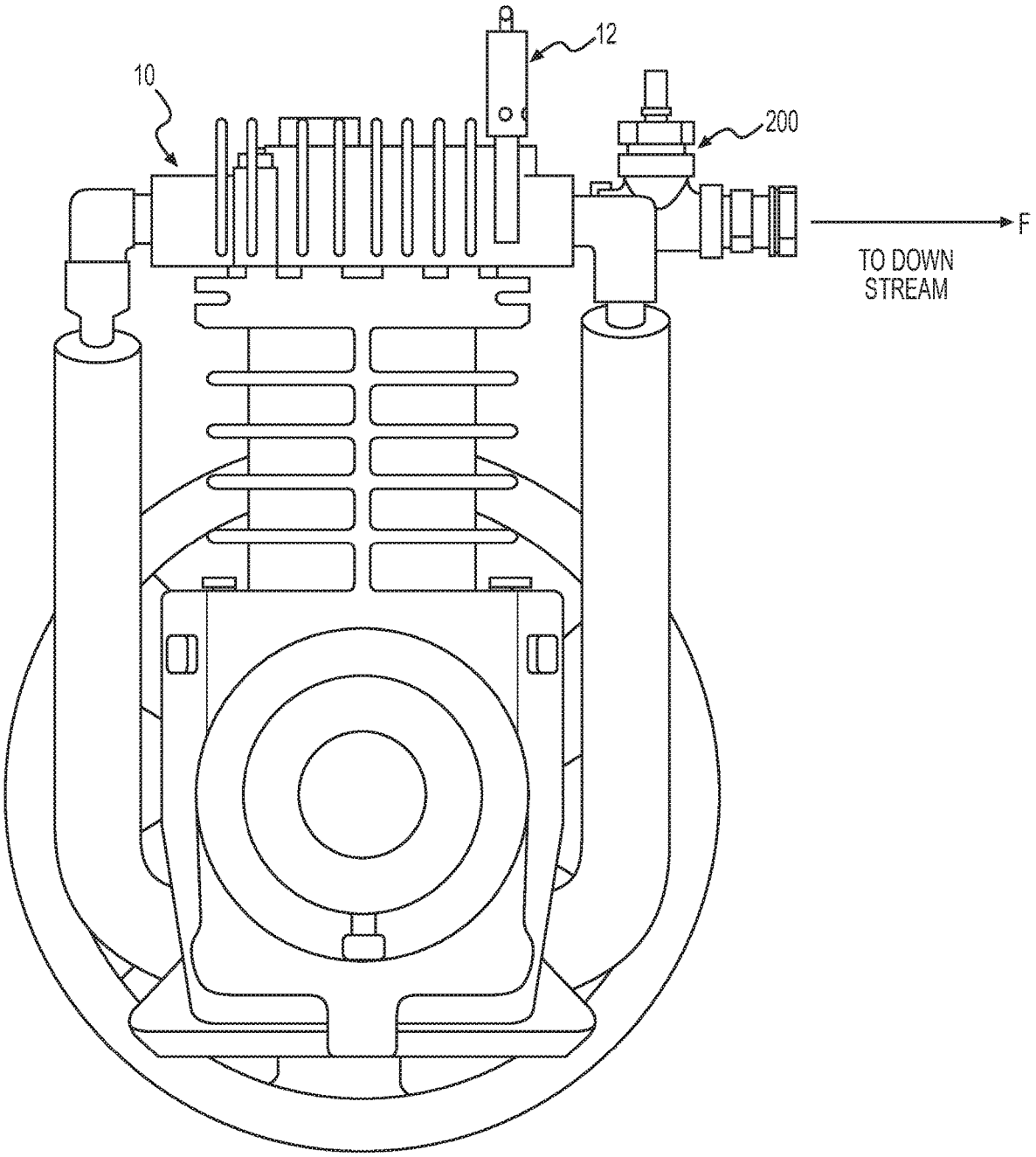
FIG. 1B illustrates the process flow of the compressor with the start-up valve according to the present invention.

FIGS. 1A-1B illustrate a compressor, which can be a single or two stage reciprocating compressor or piston compressor, a centrifugal compressor, a scroll compressor, a screw compressor having male and female compressor elements, or the like, that includes a start-up valve 200 according to the present invention. In this embodiment, the compressor 10 is a reciprocating compressor having a piston cylinder for compressing gas, e.g., air. Other embodiments may comprise multiple piston cylinders. Gas for compressing is received from a gas inlet 12 of the compressor 10. The start-up valve 200 is provided at the discharge 14 of the compressor 10, where the compressed gas is provided in the direction of the flow F. The compressor 10 is driven through a pulley 18 and belt (not shown) by a motor (not shown). In other embodiments, a gas driven or electrically driven motor may rotate the crankshaft to reciprocate the piston(s) to compress the gas in the piston cylinder(s) of the compressor 10. The compressed gas is then discharged from the compressor 10 through discharge 14 to a pipe (not shown) or the like, to a storage tank (not shown). The compressed gas may be distributed to users from the storage tank. In other embodiments, the compressed gas may be distributed directly to users.

The start-up valve 200 is provided at the discharge 14 of the compressor 10, where the start-up valve can be attached directly at the outlet of the compressor or attached to a tubing connected to the outlet of the compressor. The start-up valve 200 can be connected by screw-fitting, compression fitting, bolted, welded, or other fastening means for connecting the start-up valve to the outlet of the compressor or the tubing. A check-valve may be provided between the start-up valve 200 and a storage tank to allow the discharge of gas through the start-up valve 200 without affecting the pressure in the storage tank.

Figure 2:
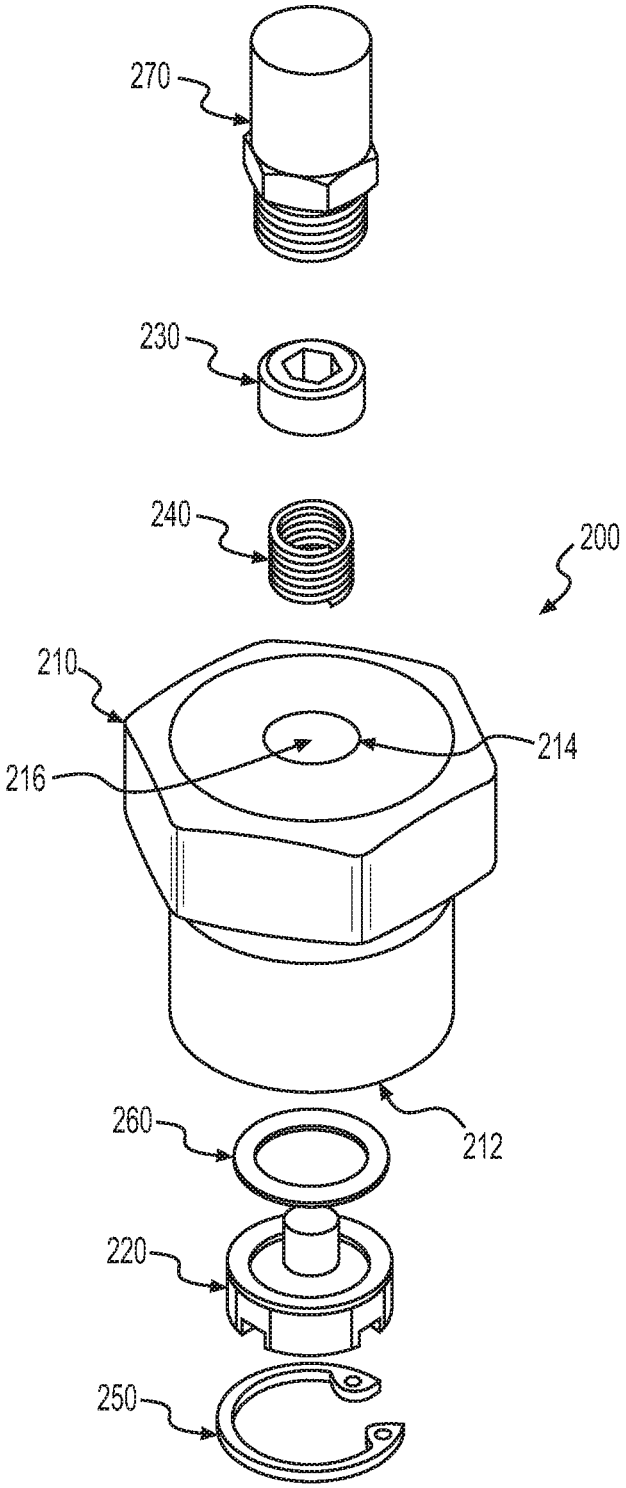
FIG. 2 illustrates an exploded perspective view of a start-up valve according to the present invention.

FIG. 2 illustrates a start-up valve comprising a valve body 210, a valve plunger 220, an adjustment bolt 230, a spring 240, a retaining ring 250, an O-ring 260, and a muffler 270. The valve body 210 comprises an inlet 212 and an outlet 214 and includes a passageway 216 through the valve body 210 that connects the inlet 212 and the outlet 214, e.g., hollow center or connection passageways through the valve body.

Figure 3:
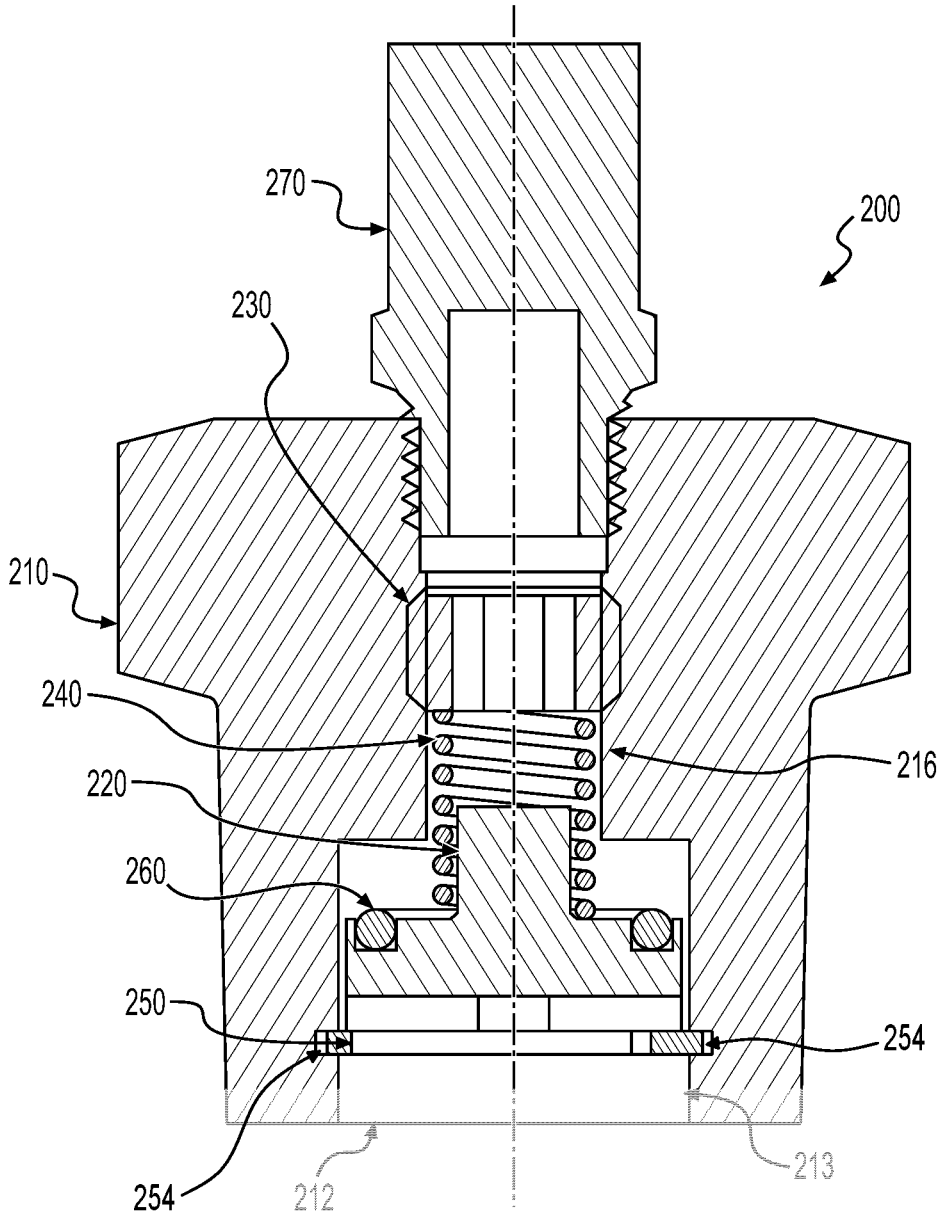
FIG. 3 shows a cross-sectional view of a start-up valve according to the invention.

FIG. 3 illustrates inlet 212 of the valve body 210 includes a chamber 213 in which gas from the compressor enters into the valve body 210. The chamber 213 can include a plurality of openings to allow gas to flow from/towards the compressor, the receiver, and/or towards the inlet 212 of the valve body 210, e.g., a first opening can be connected to the discharge of the compressor, a second opening is connected to the inlet of the valve body, and a third opening is connected to a receiver of the compressor. Alternatively, an opening can be provided within the chamber 213 that is connected to the receiver, which is sealed by the valve plunger 220 when the spring 240 is in the relaxed state, but opened when the spring 240 is in the compressed state and the valve plunger 220 abuts the passageway 216.

The valve plunger 220, retaining ring 250, and O-ring 260 are provided within the chamber 213. Specifically, the retaining ring 250 is provided within engagement slots 254 provided along the walls of the chamber 213 and below the valve plunger 220 and can be made from metal, carbide, hard plastic, or the like to be able to retain the valve plunger 220 within the valve body 210 of the start-up valve 200. The valve plunger 220 includes a body, plunger, and slots through or around the body of the valve plunger 220 and positioned so that the plunger of the valve plunger 220 is slidably engageable with the passageway 216 of the valve body 210. The O-ring 260 is provided within a seat of the body of the valve plunger 220 which has a diameter greater than a diameter of the passageway 216. The O-ring may be a sealing gasket or the like.

Connected to the plunger of the valve plunger 220 is a spring 240, which is provided within the passageway 216. One end of the spring 240 engages with the body of the valve plunger 220 and the other end engages with the adjustment bolt 230. The adjustment bolt 230 allows the adjustment of the amount of gas flow through the start-up valve 200 (which can increase or decrease back pressure) by adjusting the tension on the spring 240, e.g., the adjustment bolt 230 can be threaded to compress the spring 240. That is, the adjustment bolt 230 provides a means to set different levels of gas flow through the start valve for different sized compressors. It is also appreciated that different springs can be used with different elasticities and spring constants for different sized compressors.

At the outlet 214 of the valve body 210, the muffler 270 is provided, which can be attached to the valve body 210 by a screw fitting within the passageway 216, welded, glued, or by other fitting or fastening means for attaching the muffler 270 to the valve body 210. The muffler 270 discharges gas to the atmosphere and preferably includes a soft porous material which is commonly used with air-powered tools to reduce noise and filter exhaust fumes and can include a support, O-rings, tube stem that is inserted into the passageway, or other similar structure. For example, gas flows through a passageway within the muffler 270 and discharged through the soft porous material to the atmosphere.

Figure 4A:
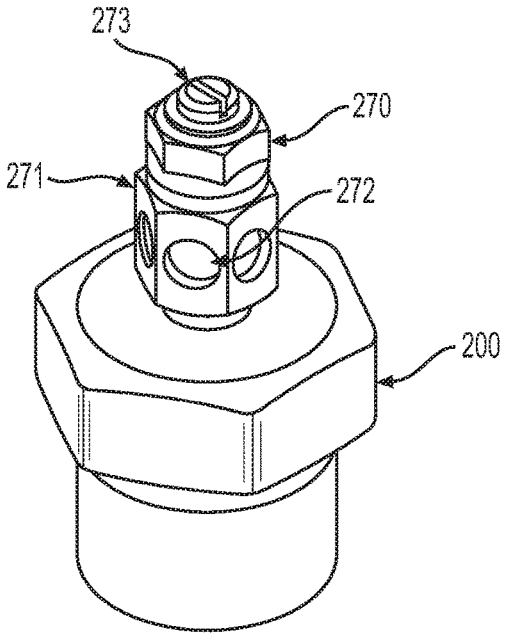
FIGS. 4A-4C illustrate an embodiment of the start-up valve with an embodiment of a muffler.
Figure 4B:
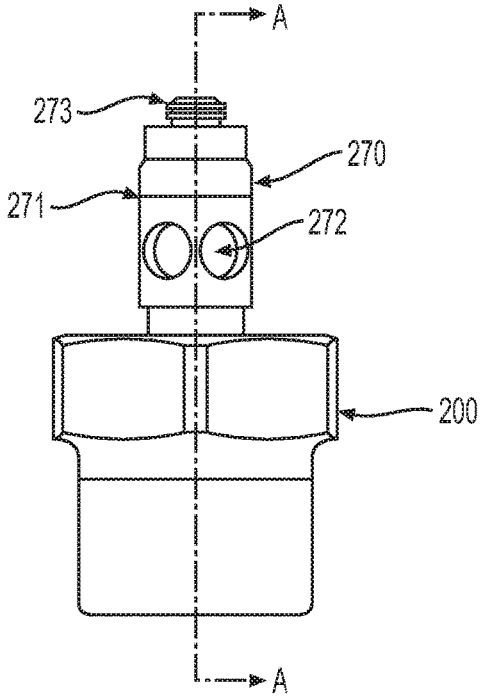
Figure 4C:
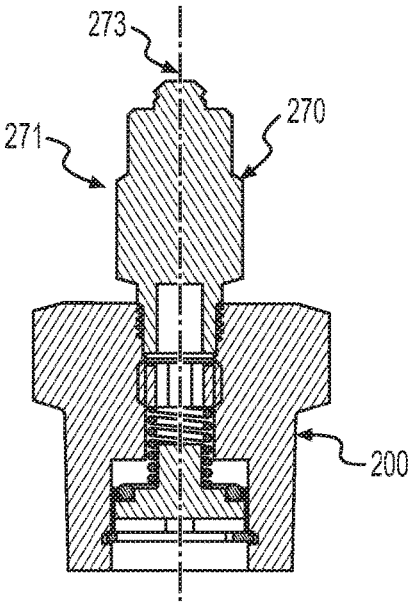

As seen in FIGS. 4A-4C, in one embodiment of the muffler, the muffler 270 is provided with a support 271 having multiple openings 272 around the circumference of the support. The muffler 270 includes an adjustment screw 273 that allows the adjusting of the amount of gas flow through the start-up valve 200. It is appreciated that this muffler design can include the adjustment bolt 230 or the adjustment screw 273 can be directly engaged with the internal passageway 216, where the adjustment screw 273 is rotated to change the relative position of the adjustment screw 273 to change the amount of gas flow through the porous material within the support 271.

Figure 5A:
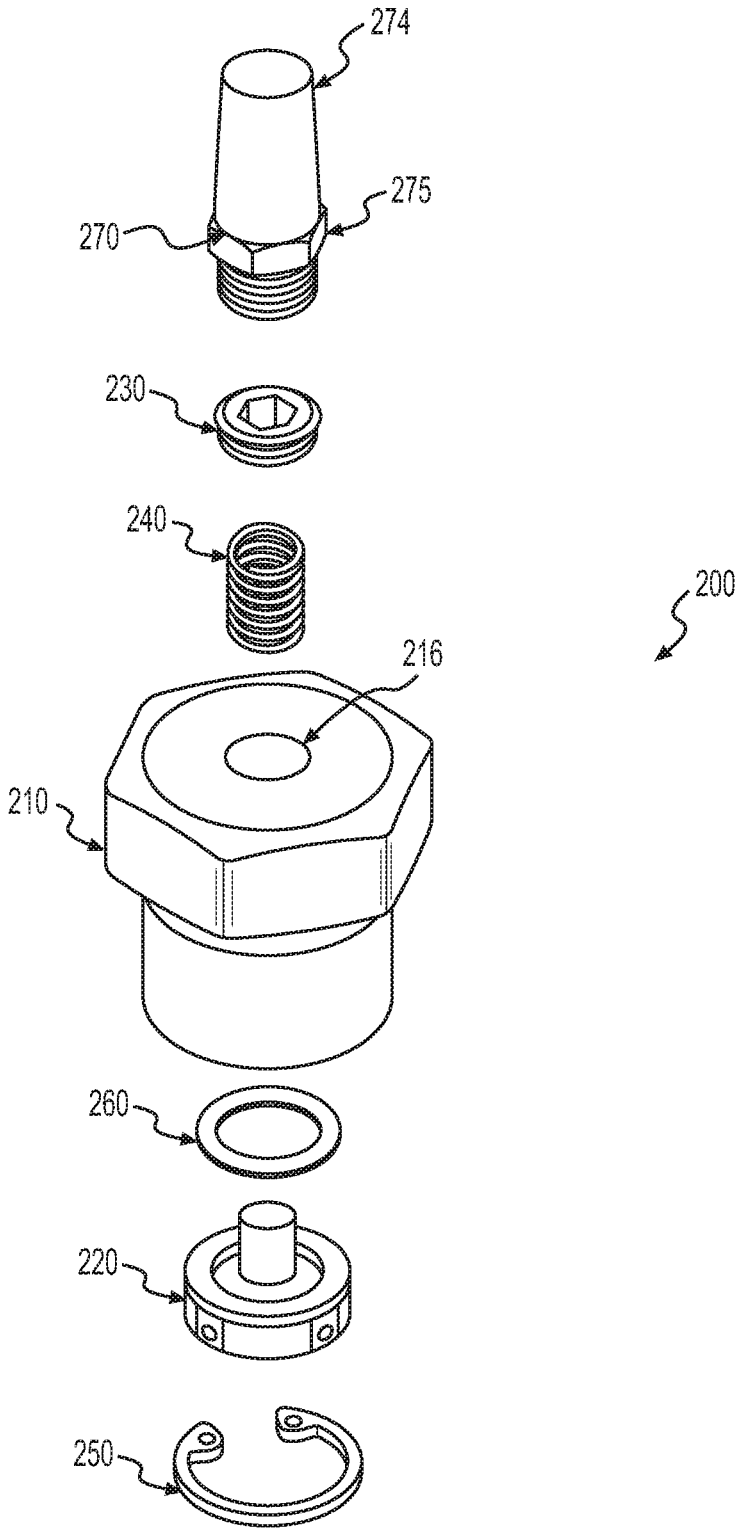
FIGS. 5A-5B illustrate an embodiment of the start-up valve with another embodiment of the muffler.
Figure 5B:
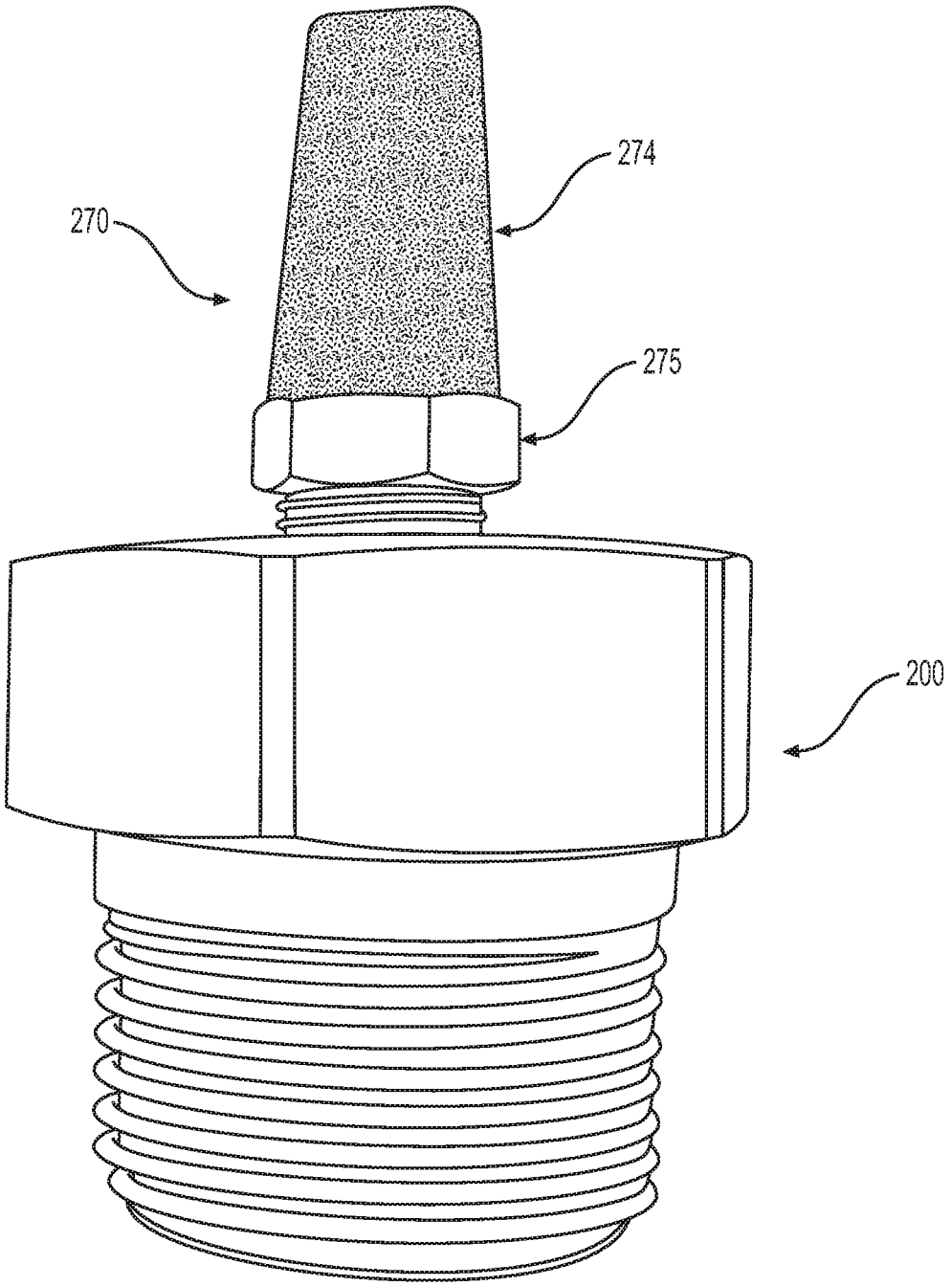

As seen in FIGS. 5A-5B, in another embodiment of the invention, the muffler 270 includes a soft porous body 274 attached to a support 275 having the screw fitting for engaging with the valve body of the start-up valve 200. Specifically, the muffler 270 is attached at one end of the valve body 210, where the adjustment bolt 230 and spring 240 are positioned in the passage 216 between the valve plunger 220 and the muffler 270. The O-ring 260 is provided on a surface of the valve plunger 220, which is retained in the valve body 210 by retaining ring 250.

The operation of the start-up valve is as follows (with reference to FIG. 3): After the start-up valve 200 is connected to the discharge side of the reciprocating compressor and the reciprocating compressor is started, the compressed gas enters at a bottom, e.g., inlet 212, of the valve body 210, where the compressed gas flows around the valve plunger 220. The compressed gas then flows through the passage 216 of the valve body 210 and out of the outlet 214 of the valve body 210 through the muffler 270. As the compressor continues its startup procedure, the gas flow increases as the motor reaches full speed. As the gas flow increases, e.g., increases in pressure, the gas flow pushes the valve plunger 220 towards a top portion of the inlet, which compresses the spring 240. When the valve plunger 220 reaches the top of the chamber, the O-ring 260 abuts an area around the passageway 216 which seals off any further gas flow through the start-up valve 200 and the compressor delivers compressed gas normally to the receiver (or end users).

Similarly, when a compressor is shut-down, as the pressure in the compressor system is decreased, e.g., due to the compressor being shut down or pressure in the receiver is released where no check-valve is included or pressure is bled out of the discharge side of the compressor, the spring 240 returns to its relaxed state which forces the valve plunger 220 (and O-ring 260) away from the internal passageway to allow gas to flow around the valve plunger 220 and valve body 210 and exit out of the muffler 270. This action unloads the pressure in the compressor to allow a loadless start-up of the compressor, as necessary. The spring in the relaxed state has a longer length than the spring when the spring is in a compressed state, e.g., the spring is compressed with increased compressor pressure and relaxed with decreased compressor pressure.

In view of such structure and features, the present invention solves the deficiencies of the prior art by providing a loadless start-up valve for a compressor installation which is able to discharge compressor pressure for a loadless start-up of the compressor. This is an improvement over the prior art in several ways. These features cost less than a compressor designed in a special way for unloading or that uses a solenoid valve for unloading. The present invention also provides a smaller sized device for unloading that can be attached directly to the compressor discharge, e.g., by a screw fitting.

The invention discussed herein is directed to specific embodiments, but the design is not limited to the description of the exemplary invention but only by the scope of the appended claims. As a result, there are multiple embodiments that employ the beneficial characteristics of the invention, each providing a different advantage and which are combinable and/or interchangeable with various aspects of the different embodiments of the invention that do not depart from the spirit and scope of the invention.

What is claimed is:

1. A start-up valve comprising:

a valve body having an inlet, an internal passageway, and an outlet, a valve plunger connected at the inlet of the valve body comprising a base portion and a top portion, said base portion having a diameter greater than a diameter of the internal passageway and comprising slots, a spring provided within the internal passageway and connected to the valve plunger, wherein the start-up valve is configured in a way such that when the spring is in a relaxed state, the valve plunger is positioned away from the internal passageway so that a flow of gas is able to flow around or through the slots of the base portion to the internal passageway, and wherein when the spring is in a compressed state, the base portion of the valve plunger abuts the internal passageway and seals the inlet of the valve body in a way such that the flow of gas to the inlet is not able to flow through or around the base portion of the valve plunger to the internal passageway.

2. The start-up valve according to claim 1, further comprising a muffler attached to the outlet of the valve body, said muffler being configured to reduce noise when gas is vented through the muffler.

3. The start-up valve according to claim 1, further comprising a sealing ring connected to the valve plunger, wherein when the spring is in the compressed state, the sealing ring abuts an area around the internal passageway to seal the inlet.

4. The start-up valve according to claim 3, wherein the valve body includes a chamber, wherein as the spring is compressed, the valve plunger is pushed to a top portion of the chamber until the sealing ring seals the inlet of the valve body.

5. The start-up valve according to claim 1, further comprising an adjustment bolt, wherein the adjustment bolt is adjustable to change an amount of gas flow through the start-up valve.

6. The start-up valve according to claim 1, further comprising a retaining ring, said retaining ring configured to retain the valve plunger within the valve body.

7. The start-up valve according to claim 1, further comprising a muffler attached to the outlet of the valve body, said muffler comprising a soft porous material.

8. A gas compressor installation comprising:

a compressor, said compressor comprising a compressor inlet and a compressor outlet;

a start-up valve connected to the compressor outlet, said start-up valve comprising:

a valve body having a valve inlet, an internal passageway, and a valve outlet, a valve plunger connected at the valve inlet comprising a base portion and a top portion, said base portion having a diameter greater than a diameter of the internal passageway and comprising slots, a spring provided within the internal passageway and connected to the valve plunger, wherein the start-up valve is configured in a way such that the spring is in a relaxed state during a shut-down or start-up of the compressor so that the valve plunger is positioned away from the internal passageway to allow a flow of gas to flow through or around the slots of the base portion of the valve plunger through the valve body, and wherein as a gas pressure increases as the compressor is operated, the spring is compressed until the base portion of the valve plunger abuts the internal passageway to shut off the flow of the gas through the valve body in a way such that the flow of gas to the inlet is not able to flow through or around the base portion of the valve plunger to the internal passageway.

9. The compressor installation according to claim 8, further comprising a muffler attached to the valve outlet.

10. The compressor installation according to claim 9, wherein the muffler comprises a soft porous material to reduce a noise of the gas vented through the muffler.

11. The compressor installation according to claim 8, wherein the start-up valve further comprises a sealing ring connected to the valve plunger, wherein when the spring is in a compressed state, the sealing ring abuts an area around the internal passageway to seal the valve inlet.

12. The compressor installation according to claim 11, wherein the valve body includes a chamber, wherein as the spring is compressed, the valve plunger is pushed to a top portion of the chamber and the sealing ring seals the valve inlet.

13. The compressor installation according to claim 8, wherein the start-up valve further comprises an adjustment bolt, wherein the adjustment bolt is adjustable to change an amount of the gas flow through the start-up valve.

14. The compressor installation according to claim 8, wherein the start-up valve further comprises a retaining ring, said retaining ring configured to retain the valve plunger within the valve body.

15. The compressor installation according to claim 8, wherein the start-up valve is threadedly connected to a discharge pipe on the outlet of the compressor.

16. The compressor installation according to claim 15, further comprising a check valve between the start-up valve and a storage tank.

17. A method of operating a gas compressor to compress a gas comprising the steps of:

starting the gas compressor with a compressor outlet that comprises a self-closing mechanical start-up valve having an opening that is open to an atmosphere that surrounds the compressor, and that vents gas to the atmosphere through a muffler, wherein the self-closing mechanical start-up valve comprises a valve body having an inlet, an internal passageway, and an outlet, a valve plunger connected at the inlet of the valve body comprising a base portion and a top portion, said base portion having a diameter greater than a diameter of the internal passageway and comprising slots, and a spring provided within the internal passageway and connected to the valve plunger, wherein the self-closing mechanical start-up valve is opened by relaxing the spring so that the valve plunger is positioned away from the internal passageway so that a flow of gas flows around or through the slots of the base portion to the internal passageway; and as the starting is completed, closing the compressor outlet from the atmosphere, wherein said closing comprises compressing the spring so that the base portion of the valve plunger abuts the internal passageway and seals the inlet of the valve body in a way such that the flow of gas to the inlet is not able to flow through or around the base portion of the valve plunger to the internal passageway.

* * * * *